US007004559B2

(12) United States Patent
Aliaga

(10) Patent No.: US 7,004,559 B2
(45) Date of Patent: Feb. 28, 2006

(54) METHOD AND APPARATUS FOR INK JET PRINT HEAD NOZZLE PLATE CLEANING

(75) Inventor: Christophe Aliaga, Juillan (FR)

(73) Assignee: Scitex Vision Ltd., Netanya (IL)

( * ) Notice: Subject to any disclaimer, the term of this patent is extended or adjusted under 35 U.S.C. 154(b) by 223 days.

(21) Appl. No.: 10/728,859

(22) Filed: Dec. 8, 2003

(65) Prior Publication Data

US 2005/0122371 A1 Jun. 9, 2005

(51) Int. Cl.
*B41J 2/165* (2006.01)

(52) U.S. Cl. ..... 347/25

(58) Field of Classification Search ..... 347/22, 347/35, 30, 36; 239/298; 134/167 R, 169 R; 210/409, 410

See application file for complete search history.

(56) References Cited

U.S. PATENT DOCUMENTS

| | | | | |
|---|---|---|---|---|
| 4,591,873 | A * | 5/1986 | McCann et al. | 347/25 |
| 4,970,535 | A | 11/1990 | Oswald et al. | |
| 5,184,147 | A | 2/1993 | MacLane et al. | |
| 5,493,319 | A | 2/1996 | Hirabayashi et al. | |
| 6,196,657 | B1 | 3/2001 | Hawkins et al. | |
| 6,497,472 | B1 | 12/2002 | Sharma et al. | |

* cited by examiner

*Primary Examiner*—Shih-Wen Hsieh
(74) *Attorney, Agent, or Firm*—Mark M. Friedman

(57) ABSTRACT

The present invention provides a method of non-contact, ink jet print head nozzle plate surface cleaning. The method disclose, enables simultaneous non-contact cleaning of all nozzles of a print head nozzle plate having a major and minor dimension and ink ejecting nozzles spanning most of the major dimension. The simultaneous non-contact cleaning of all nozzles of the print head is achieved by providing a print head cleaning arrangement having a pressurized air flow emerging from an air exit slit of length exceeding nozzle plate major dimension.

10 Claims, 10 Drawing Sheets

METHOD AND APPARATUS FOR INK JET PRINT HEAD NOZZLE PLATE CLEANING

FIELD OF THE INVENTION

The present invention generally relates to cleaning and maintenance stations for inkjet print head nozzle plate cleaning an maintenance and to method of cleaning and maintenance of ink jet print head nozzle plate. In particular the invention relates to non-contact method of cleaning and maintenance of inkjet print head nozzle plate.

BACKGROUND OF THE INVENTION

Inkjet printing has gained popularity in a number of applications. One of the growing printing applications is printing of billboards, banners and point of sale displays. The ink-jet printing process involves manipulation of drops of ink ejected from an orifice or a number of orifices of a print head onto an adjacent print medium or substrate. An ink-jet print head consists of an array or a matrix of ink channels or cavities each ending by an orifice or nozzle. The nozzles of an array or a matrix of ink channels are typically made on a common substrate called nozzle or orifice plate. Usually, one of nozzle plate surfaces is attached to an array or a matrix of ink channels in a way that each nozzle faces a corresponding ink channel. The other surface "open" surface faces the printed media or substrate. Each nozzle selectively ejects ink droplets in the direction of the printing substrate. A given nozzle of the print head ejects the ink droplet in a predefined print position on the media. An assembly of the adjacently positioned on the media ink droplets creates a predetermined print pattern or image. Relative movement between the media or substrate and the print head enables printing substrate coverage and image creation. The selection of printing media is large and varies from paper and fabric to metal and glass.

The quality of the print produced by an ink jet printer to a large extent depends on the state of the nozzle plate and especially the surface of the nozzle plate. Dry and free of debris nozzle plate surface enables accurate droplet placement reducing droplet position caused printing artifacts. It is however, difficult to maintain the nozzle plate surface dry and free of debris. Ink mist formed during droplet ejection process resides on the nozzle plate surface; dust, paper and fabric lint remain on the nozzle plate surface. When printing is performed with UV curable ink, ink mist and residue might be cured by stray light on the nozzle plate surface. Although different coatings to reduce nozzle plate surface wetting and static attraction have been developed only repetitive and frequent nozzle plate surface cleaning helps to maintain correct operating status of the nozzle plate.

There is a number of techniques developed for cleaning of the "open" or facing the printed media nozzle plate surface. Some of these techniques relay on a simple wiping process, where a soft blade, such as one made of fluoro-silicone wipes the nozzle plate surface periodically. This operation wipes out debris and excess ink from the nozzle plate surface returning it to the original dry and free of debris state. The drawback of this technique is that debris and excess ink can contaminate some of the nozzles during the wiping step. Moreover residual ink located on the soft blade may contaminate the nozzle plate surface and therefore lead to a result opposite to what was expected.

The soft blade wiping method is not applicable to print heads operating with UV curable ink. Often UV curable ink residue always present on the soft blade cures or is in process of curing becoming a hard body. Wiping nozzle plate surface with a blade having on it cured ink particles not only scratches the nozzle plate surface, it contaminates the nozzle plate and clogs the nozzles making the print head unusable.

Another method of wiping is by a cloth wetted in a cleaning solution. The cloth is rolled from a roller-to-roller and thus avoids nozzle plate surface contamination, however lint and hard particles that are present in the debris may scratch the nozzle plate surface and damage the anti-wetting coating.

Methods of non-contact cleaning by a stream of fluid are also known in the art. U.S. Pat. No. 4,970,535 to Oswald et al., discloses an ink jet print head face cleaner that provides a controlled air passageway through an enclosure formed against the print face. Air is directed through an inlet into a cavity in a body. The body has a face with an opening into the cavity. This face is sealingly placeable against the print face. The cavity has a limited size so that air is directed without interruption through the cavity past the ink jet apertures, and out an outlet. The cleaner body is coupled resiliently to a platform to allow positioning of the body and print faces flush with each other. A vacuum source is preferably attached to the outlet to create a sub-atmospheric pressure in the cavity to further seal the two faces together. A collection chamber and removable drawer are positioned below the outlet to facilitate disposing of removed ink.

The fluid stream is oriented along the nozzle plate and moves ink residue from one end to another. There always exist a possibility that some residue will be trapped in a nozzle and clog it. Use of vacuum and sealed compartment increases the cost of the solution.

U.S. Pat. No. 6,196,657 to Hawkins et al. discloses a multi-fluidic cleaning for an ink jet print head and a method for assembling the same. The print head has a surface defining at least one orifice there through the at least one orifice being susceptible to being obstructed by contaminants. A cleaning assembly of the invention is disposed proximate the surface for directing a flow of fluid along the surface and across the at least one orifice to clean contaminants from the surface and the at least one orifice. The cleaning assembly includes a cup sealingly surrounding the at least one orifice, the cup defining a cavity therein. The cleaning assembly further includes a valve system in fluid communication with the cavity for allowing a fluid flow stream consisting of alternating segments of at least one liquid cleaning agent from a liquid cleaning agent source and another element such as a gas from a gas source or a second liquid cleaning agent from a liquid cleaning agent source into the cavity.

Hawking also requires creation of a sealed compartment that increases the cost of the solution. The fluid stream is oriented along the nozzle plate and moves ink residue from one end to another. There always exist a possibility that some residue will be trapped in a nozzle and clog it.

U.S. Pat. No. 5,184,147 to MacLane et al discloses an ink jet print head cleaning and maintenance system that has a purge chamber for applying a vacuum to a nozzle orifice surface. A specialized baffle diverts ink entering the purge chamber away a vent port through which the vacuum is drawn. An elongated wipe engages and wipes the orifice surface and is preferably moved at an extremely slow rate across the surface to enhance the wiping operation. An air knife directs a narrow stream of air across a portion of the nozzle orifice surface with air from the air stream being scanned across the surface for cleaning purposes. A specialized drip edge is positioned beneath the orifice surface for directing drops of ink away from the ink jet print head, the drops of ink being generated during the cleaning procedures. A mechanically simple cam mechanism coupled to a rotatable drum of the printer may be used to shift the maintenance system against the nozzle orifice surface for cleaning purposes.

The system however, requires a special mechanism for scanning the air stream across the surface for cleaning purposes. The cleaning system itself requires a positioning mechanism, although a simple one, to be employed for placing in a working position and returning to a idle state.

U.S. Pat. No. 6,497,472 to Sharma et al. teaches a print head that comprises a print head body defining an interior chamber and an orifice plate. The orifice plate has an outer surface and further defines a cleaning fluid orifice through the orifice plate for conducting a flow of a cleaning fluid through the cleaning fluid orifice and onto an outer surface of said orifice plate. The orifice plate also defines a drain orifice for conducting a flow of cleaning fluid from the surface to the interior chamber. A supply of pressurized cleaning fluid is disposed in said cavity and connected to the cleaning fluid passageway. During cleaning operations, the fluid flow system defines a flow of a cleaning fluid from the passageway and onto said outer surface. The drain orifice receives cleaning fluid from the outer surface and channels the cleaning fluid into the fluid return.

Sharma discloses that all print head facilities are part of the print head and accordingly the cost of the print head is increased. Special sealed compartment through which the cleaning solution flows is temporarily created for the cleaning process.

Therefore, there is a need in the industry in for a method of non-contact, ink jet print head nozzle plate surface cleaning solution. A solution that would provide nozzle plate cleaning without mechanical contact between the nozzle plate and the cleaning tool and would not require manual interference.

All of the above mentioned print head cleaning methods and devices are adapted to clean only one print head at a time. Most of the present ink jet printing system is printing with a block of print heads, where a number of print heads print the same color. This enables the printers of getting a higher throughput and high printed image density. The prior art solutions do not suggest a method of non-contact or contact simultaneous (parallel) cleaning of all print heads.

There is also a need in the industry for a cleaning solution that would not contaminated by the cleaning fluid stream the ink ejecting nozzles.

There is a further need in a cleaning solution that would not require special sealed compartments or vacuum for residue removal. A cleaning solution that could be easy portable from one print head shape to a print head having a different shape of width or array length.

SUMMARY OF THE INVENTION

It is therefore an object of the present invention to provide a method of non-contact, ink jet print head nozzle plate surface cleaning solution. A solution that would provide nozzle plate surface cleaning without mechanical contact between the nozzle plate and the cleaning tool and would not require manual interference.

It is an additional object of the present invention to provide a method of non-contact ink jet print head nozzle plate surface cleaning solution that enables simultaneous (parallel) cleaning of a large number of print heads.

It is a further object of the present invention to provide a non-contact ink jet print head nozzle plate surface cleaning solution, where the flow of the cleaning fluid that would not contaminate the ink ejecting nozzles.

It is still an additional object of the present invention to provide a non-contact ink jet print head nozzle plate surface cleaning solution that would not require special sealed compartments or vacuum for residue removal. A cleaning solution that could be easy portable from one print head shape to a print head having a different shape of width or array length.

These and other objects of the invention could be achieved by a non-contact ink jet print head nozzle plate surface cleaning method, comprising steps of:

a) providing an ink jet print head with a nozzle plate having an open surface with major and minor dimension, and at least one linear array of ink ejecting nozzles substantially spanning the major dimension;
b) providing an arrangement having sidewalls and a bottom and where at least one of said sidewalls is parallel to said array of ink ejecting nozzles, said sidewall having a pressurized air conducting channel and an air exit slit exceeding said nozzle plate major dimension;
c) supplying a pressurized air stream exceeding through said slit in said sidewall and hitting at an angle said nozzle plate surface;
d) providing ink and debris collecting means being in communication with said arrangement bottom, and
e) cleaning said jet print head nozzle plate surface by scanning said open surface with said pressurized air stream and collecting the ink residue and debris by said ink and debris collecting means.

There is also provided according to the teachings of the present invention, a non-contact ink jet print head nozzle plate surface cleaning method wherein said scanning open surface movement is part of a regular scanning pass or part of a scheduled scanning pass. The frequency of the scheduled scanning pass depends on the nozzle plate surface conditions and printed results.

There is also provided according to the teachings of the present invention, a method of non-contact ink jet print head cleaning with an air flow stream wherein the length of said air exit slit is equal or larger than said nozzle plate surface major dimension and parallel to said air exit slit or the largest dimension of a two-dimensional (matrix) nozzle array.

There is also provided according to the teachings of the present invention, a method of non-contact ink jet print head cleaning wherein each section of said pressurized air stream cleans only one appropriate nozzle of a nozzle array and where the angle at which pressurized air stream is hitting said nozzle plate surface is less than 90 degrees.

There is also provided according to the teachings of the present invention, a method of non-contact ink jet print head cleaning wherein ink and debris collecting means are disposable means such as sponge, cloth and similar. Alternatively, ink and debris collecting means may be connected to a drain.

There is also provided according to the teachings of the present invention, a non-contact ink jet print head nozzle plate surface cleaning method, comprising steps of:

a) providing an ink jet print head with a nozzle plate having an open surface and at least one linear array of ink ejecting nozzles;
b) providing a vacuum suction arrangement being capable of moving along said nozzle plate surface of said print head;

c) supplying a vacuum for removing excessive amounts of ink said nozzle plate surface;

d) providing an arrangement having sidewalls and a bottom and where at least one of said sidewalls is parallel to said array of ink ejecting nozzles, said sidewall having a pressurized air conducting channel and an air exit slit;

e) supplying a pressurized air stream exceeding through said slit in said sidewall and hitting at an angle said nozzle plate surface;

f) providing ink and debris collecting means being in communication with said arrangement bottom, and g) cleaning said jet print head nozzle plate surface by scanning said open surface with said vacuum suction and said pressurized air stream and collecting the ink residue and debris by said ink and debris collecting means.

BRIEF DESCRIPTION OF THE DRAWINGS

The invention is herein described, by way of non-limiting example only, with reference to the accompanying drawings, wherein.

DESCRIPTION OF THE EXEMPLARY EMBODIMENTS OF THE INVENTION

The principles and execution of a method according to the present invention, and the operation and properties of an ink jet print head cleaning and maintenance device operating in accordance with the method of the present invention may be understood with reference to the drawings and the accompanying description of non-limiting, exemplary embodiments.

Figure 1:
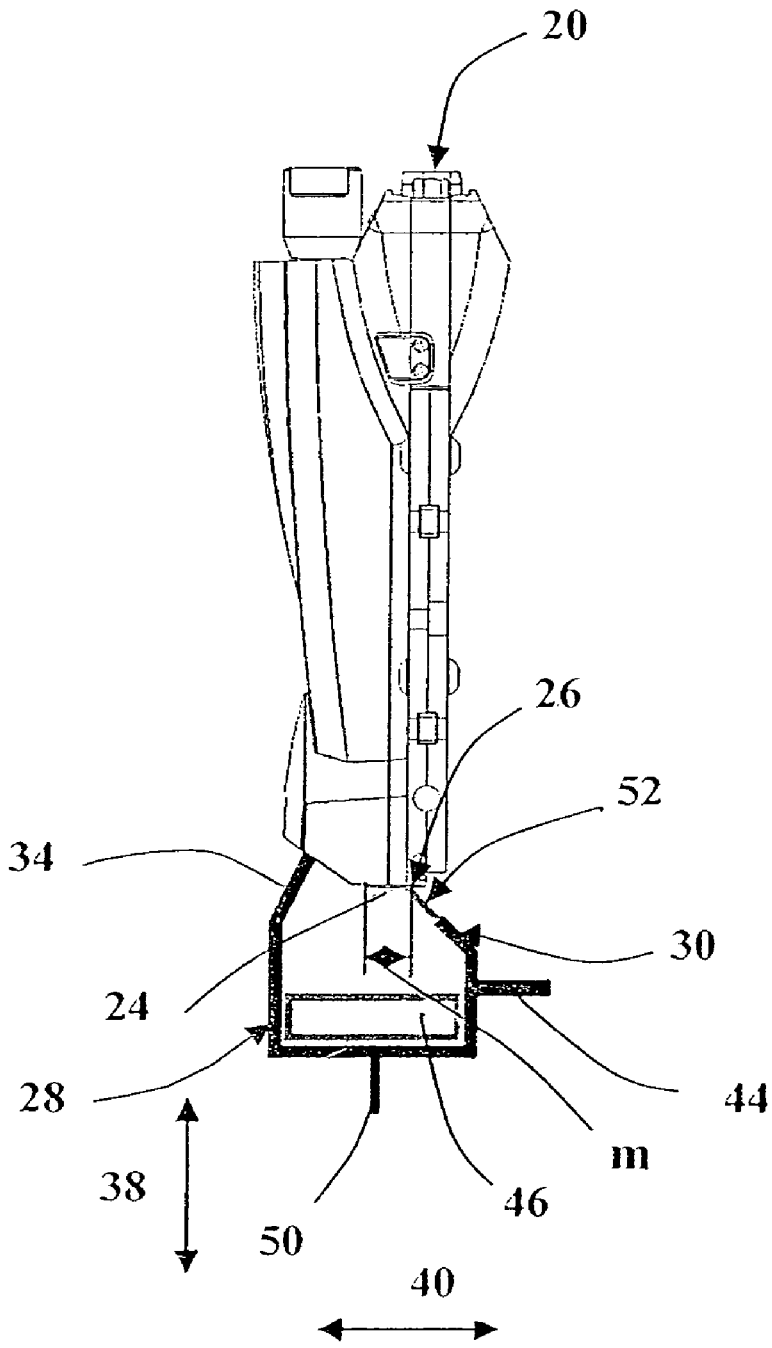
FIG. 1 is a simplified illustration of the elevation view of the non-contact nozzle plate surface cleaning device operating in accordance with the present invention.
Figure 2:
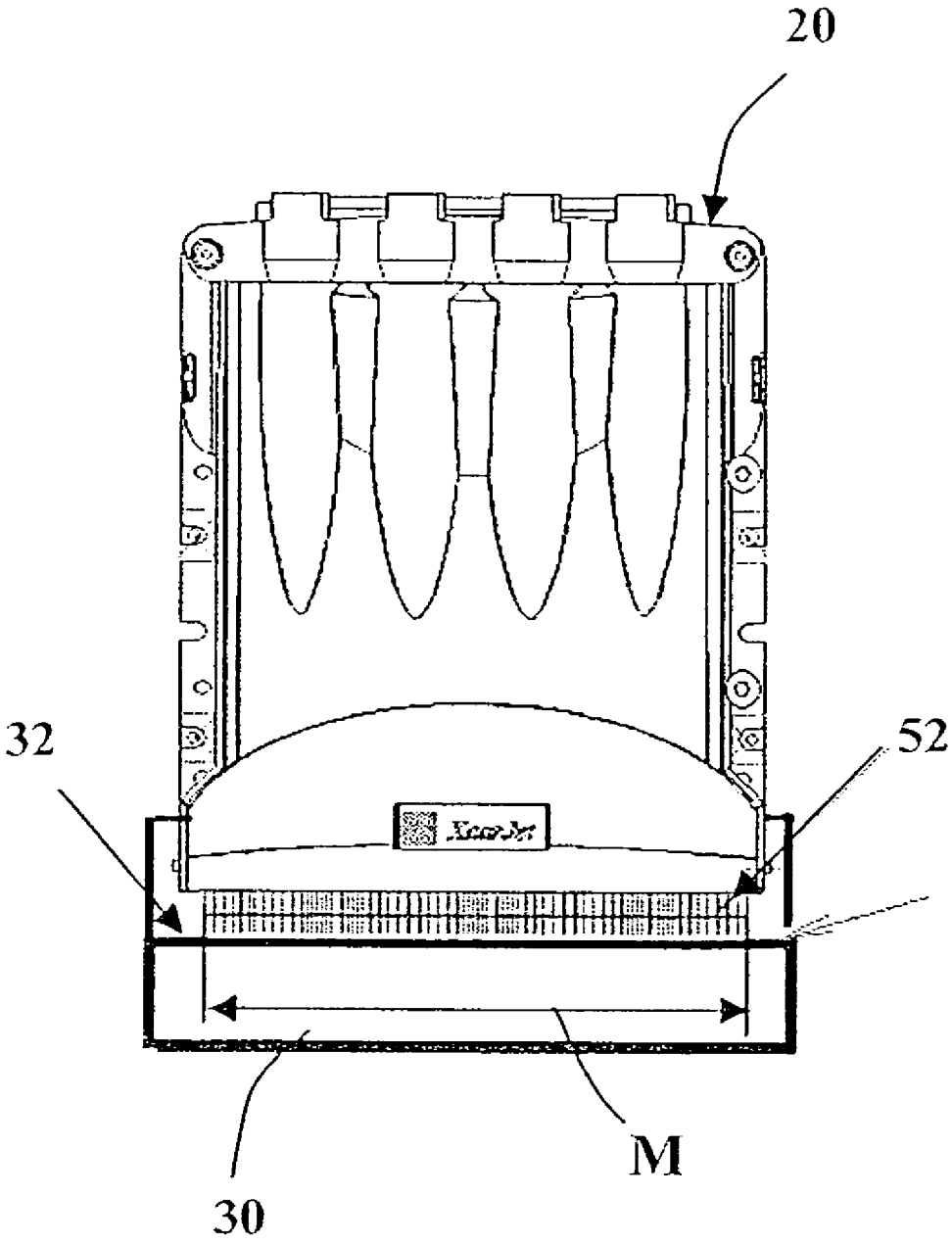
FIG. 2 is a simplified illustration of the frontal view of the non-contact nozzle plate surface cleaning device operating in accordance with the present invention.

FIG. 1 is a simplified illustration of the elevation view of the non-contact nozzle plate surface cleaning device operating in accordance with the present invention. Indicated on the figure are an ink jet print head 20 having 500 nozzles, for example such as XAAR XJ 500/360, commercially available from XAAR Ltd. Cambridge, United Kingdom, on nozzle plate surface 24, of which are ink residuals and debris 26 originating from dust and printing substrate. Nozzle plate surface 24 has a minor dimension in and a major dimension M (FIG. 2). A bathtub like arrangement 28 having sidewalls 30 and 34, and a bottom is placed close to print head 20. Arrangement 28 can move in the directions indicated by arrows 38 and 40. One of the sidewalls, for example sidewall 30 is parallel to the direction of the array of ink ejecting nozzles (not shown). Sidewall 30 is preferably hollow and is connected with the help of tubing 44 to a source of pressurized air. The part of sidewall 30 oriented towards nozzle plate surface 24 has a linear air exit opening (a slit) 32 through which pressurized air from air conducting channel 44 can exit. The length of slit 32 is equal or larger than the major dimension M of nozzle plate surface 24. Alternatively, sidewall 30 can be made solid and air stream can be delivered via a channel attached to it. Sidewall 34, opposite to sidewall 30 generally extends over the level set by nozzle plate surface 24. A fluid absorbing material 46, such as sponge or other porous or fluid absorbing material is placed on the bottom of arrangement 28; alternatively the bottom of arrangement 28 is connected by means of tubing 50 to a drain.

In accordance with the present invention the non-contact ink jet print head nozzle plate surface cleaning method is performed as follows: when the amount of ink residuals and debris 26 accumulated on nozzle plate surface 24 adversely affects the printing process arrangement 28 moves in the directions indicated by arrows 38 and 40 until print head 20 is positioned over arrangement 28. A supply of pressurized air stream begins. Pressurized air stream exceeds through the slit in sidewall 30 in form of an air knife or curtain 52. The length of air curtain 52 is at least equal or larger than the major dimension M of nozzle plate surface 24. Air curtain 52 hits at an angle surface of nozzle plate surface 24 on which ink residuals and debris 26 are accumulated. Forces created by air curtain 52 remove ink residuals and debris 26 from the surface of nozzle plate 24. Scanning movement of arrangement 28 in direction of arrow 40 might be actuated for better removal of ink residuals and debris 26. Since the length of air curtain 52 is at least equal or larger than the major dimension M of nozzle plate surface 24 air curtain 52 cleans all of the nozzles simultaneously.

FIG. 2 is a simplified illustration of the frontal view of the non-contact nozzle plate surface cleaning device operating in accordance with the present invention. Since the length of air curtain 52 is at least equal or larger than the length of nozzle plate surface 24 all of the ink ejecting nozzles are cleaned simultaneously. The direction of air curtain 52 is generally perpendicular, but not necessary, to the direction of nozzle array axis. Thus each part of air curtain 52 cleans one respective nozzle and there is no danger of clogging or contaminating one nozzle by debris removed from another nozzle. Generally, there is no need for the direction of air curtain 52 to be perpendicular to the direction of nozzle array axis. An air curtain directed at an angle to the direction of nozzle array axis will also clean in residuals and debris 26 from nozzle plate surface 24. The angle should be selected in a way that there will be no interference between parts of air curtain 52 cleaning different nozzles.

Forces created by air curtain 52 remove ink residuals and debris 26 from the surface of nozzle plate 24. Sidewall 34 that generally extends over the level set by nozzle plate surface 24 prevents spreading of removed ink residuals and debris. Removed ink residuals and debris hit sidewall 34 and flow to ink and debris collecting means 46 such as sponge or similar fluid absorbing material placed on the bottom of arrangement 28. When ink and debris collecting means 46 collect certain amount of ink they may be exchanged on fresh material and disposed. Alternatively sidewall 34 may be coated by ink and debris collecting means, such as foam or all of the arrangement 28 may be made disposable. In addition to this and in order to ensure longer operation of the printer the bottom of arrangement 28 with the help of tubing 50 is in fluid communication with a drain.

For better nozzle plate surface cleaning the air stream provided by air curtain 52 should be tangential to nozzle plate surface to be cleaned. This however, may be complicate to implement and an angle between the air stream and the nozzle plate surface will exist. The angle would be less than 90 degrees when measured between a perpendicular to the nozzle plate surface and the direction at which pressurized air stream is hitting nozzle plate surface is less than 90 degrees.

Using this method a true non-contact cleaning of the surface of the nozzle plate is accomplished in few seconds. Proper cleaning depends on the relation between such system parameters as width of linear air exit opening, air curtain to nozzle plate surface angle and time duration of the process. In the particular setting tested the distance between the surface of nozzle plate 24, and air exit slit 32 through which pressurized air from air conducting channel 44 exits was between 1 mm to 15 mm and preferably 12 mm to 8 mm, the pressure of the air stream was 0.15 to 0.5 atmosphere and preferably 0.2 to 0.3 atmosphere. The width of air exit slit 32 was 0.05 mm to 0.3 mm and preferably 0.1 mm. The speed of the relative movement between the surface of nozzle plate 24, and air curtain (stream) was 15 mm/sec to 50 mm/sec.

Figure 3:
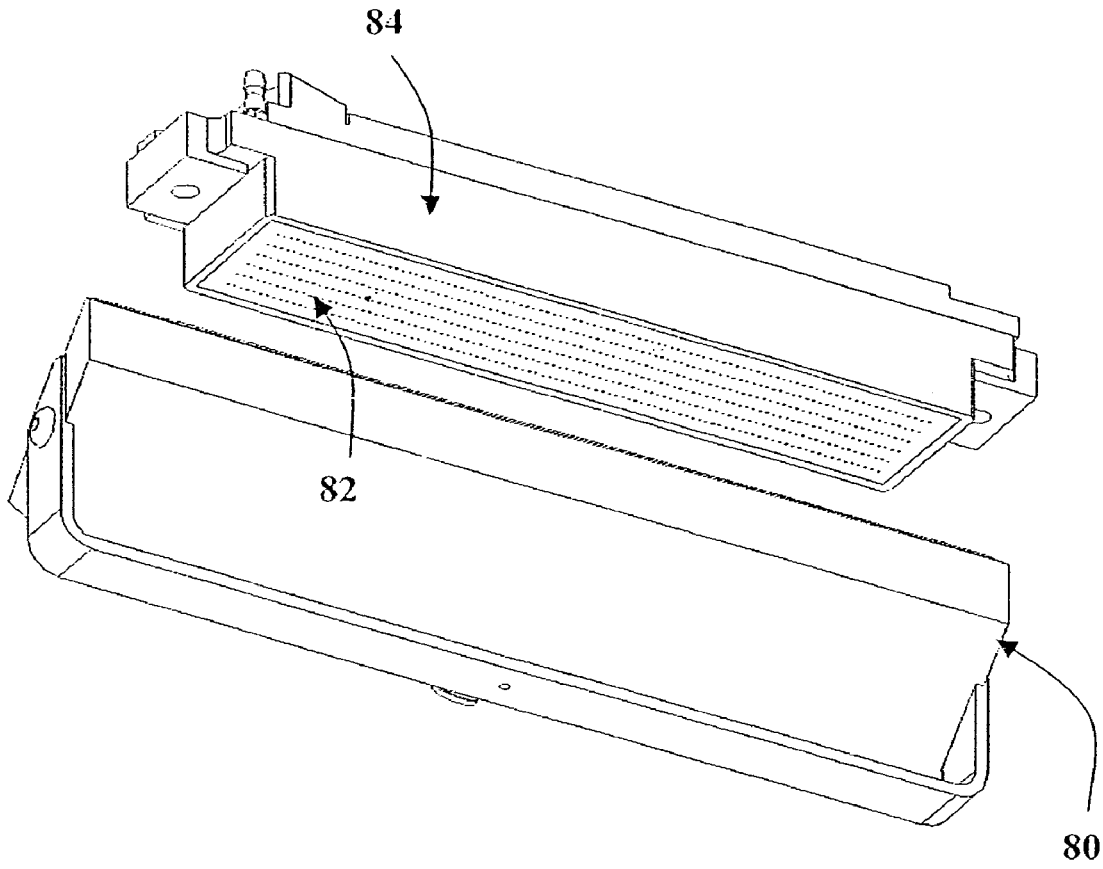
FIG. 3 is an illustration of the non-contact nozzle plate surface cleaning device operative on a two dimensional array of ink ejecting nozzles in accordance with the present invention.

Although XAAR XJ 500/360 print head having a 500 nozzles linear array was used as an example, the cleaning method is equally applicable to ink jet print head having a two-dimensional nozzle array such as MAGIC® print head, commercially available from Scitex Vision, Netanya, Israel. In each case, the nozzle arrays substantially span the major dimension of the nozzle plate, but leave relatively small attachment regions and/or inactive regions near the extremities as is generally accepted in the art. FIG. 3 is an illustration of the non-contact nozzle plate surface cleaning device 80 operative on a two dimensional array of ink ejecting nozzles 82 in accordance with the present invention. The parameters of the air curtain, angle of inclination and others are similar to the described earlier. The length of major dimension of print head 84 is 160 mm and the length of the non-contact nozzle plate surface cleaning device 80 is scaled accordingly.

The cleaning method has been described as a process that is performed only when a need arises. For the purpose of preventive maintenance the non-contact print head nozzle plate surface cleaning may be performed at the beginning or end of each printing cycle or even more frequent at the end or beginning of each scanning pass. Periodical cleaning not related to any specific cycle is also possible, although it reduces the machine throughput.

Figure 4A:
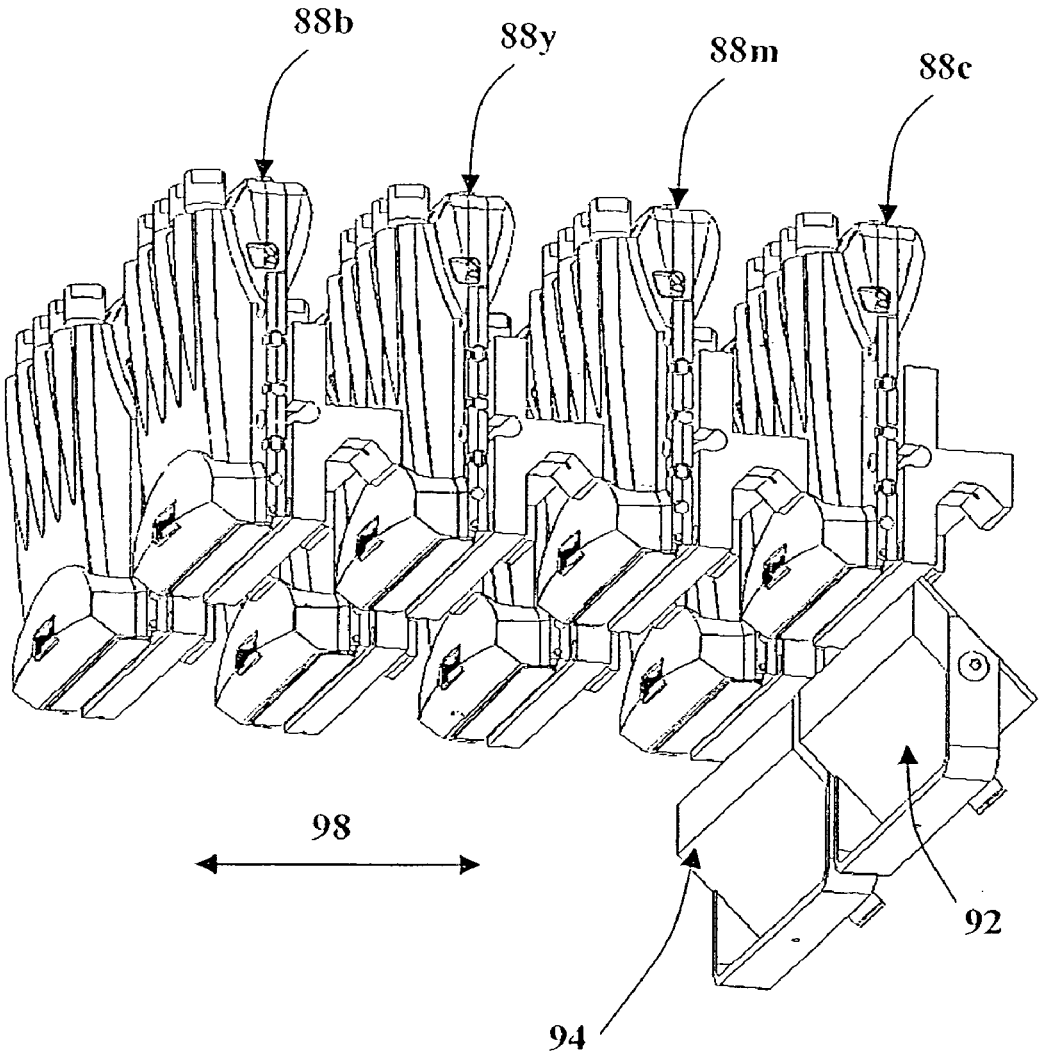
FIGS. 4A and 4B are simplified illustration is of the non-contact nozzle plate surface cleaning device operating in accordance with the present invention simultaneously on an assembly of eight print heads.

FIG. 4A is a simplified illustration of the non-contact nozzle plate surface cleaning device operating in accordance with the present invention simultaneously on an assembly of eight print heads similar to print head 20. For the simplicity of explanation some of the ink and debris collection parts are not shown. The particular arrangement of print heads 88 enables printing in a single pass all four process colors Cyan (88*c*), Magenta (88*m*), Yellow (88*y*) and Black (88*b*). Non-contact nozzle plate surface cleaning devices 92 and 94 are operative each on the respective line of print heads 88. Non-contact nozzle plate surface cleaning is accomplished by relative displacement of print heads 88 or nozzle plate surface cleaning devices 92 and 94 with respect to each other in the direction indicated by arrow 98. The parameters of the air curtain, angle of inclination and others are similar to the described earlier.

Figure 4B:
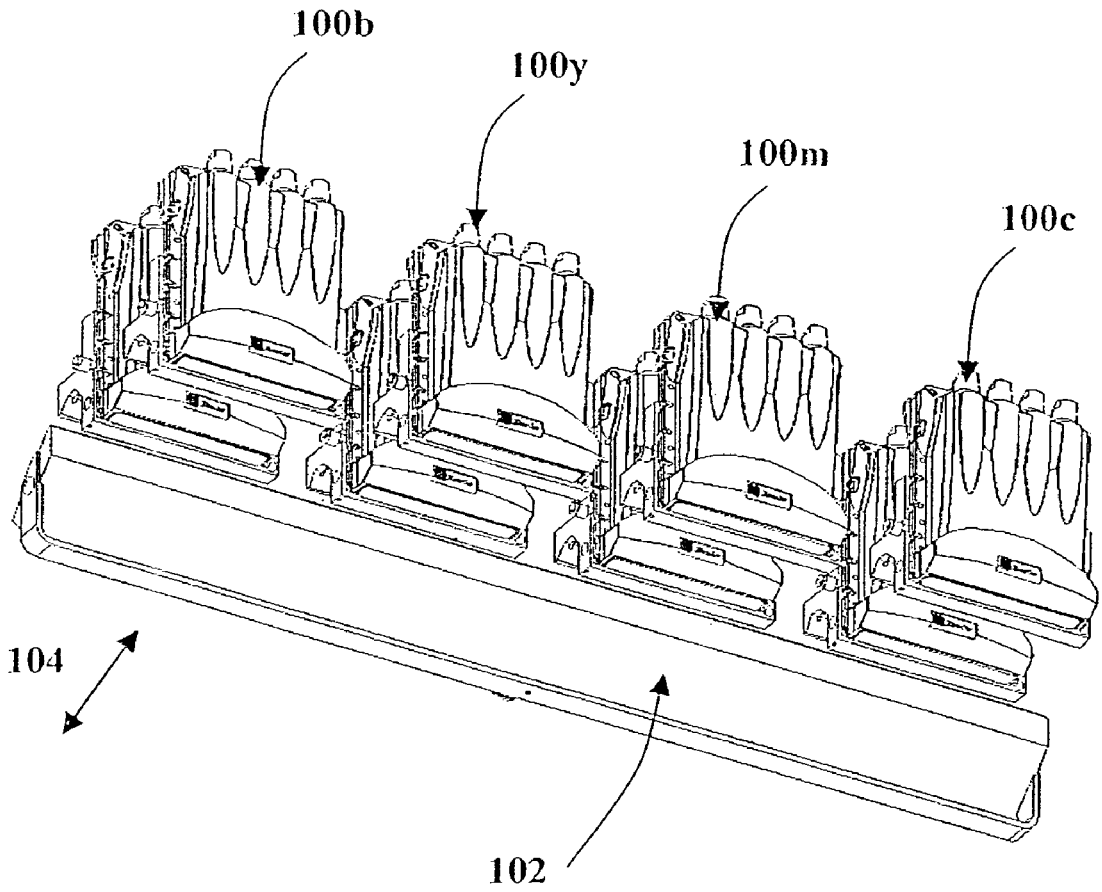

FIG. 4B is a simplified illustration of an alternative arrangement of the non-contact nozzle plate surface cleaning device operating in accordance with the present invention simultaneously on an assembly of eight print heads. The order of print heads 100 requires four passes of printing before a full four-process colors image is printed. At each pass only one color Cyan (100*c*), Magenta (100*m*), Yellow (100*y*) and Black (100*b*) is printed. This print head arrangement enables throughput higher than the arrangement of FIG. 4A. Non-contact nozzle plate surface cleaning devices 102 is operative on all nozzle plates simultaneously. Non-contact nozzle plate surface cleaning is accomplished by relative displacement of print heads 100 or nozzle plate surface cleaning devices 102 with respect to each other in the direction indicated by arrow 108. The parameters of the air curtain, angle of inclination and others are similar to the described earlier.

Ink jet print heads usually require continuous cleaning or maintenance. Since print heads do not operate continuously, maintenance may be scheduled for the end of printing cycle when the print head becomes idle. Prior art cleaning or maintenance stations require print head block movement to and from the maintenance area, where the maintenance area is typically implemented as a static portion of the substrate support surface or an additional portion of the machine. This movement requires some time and results in reduced printing duty cycle. The present invention reduces this time and increases the useful printing duty cycle.

Figure 5A:
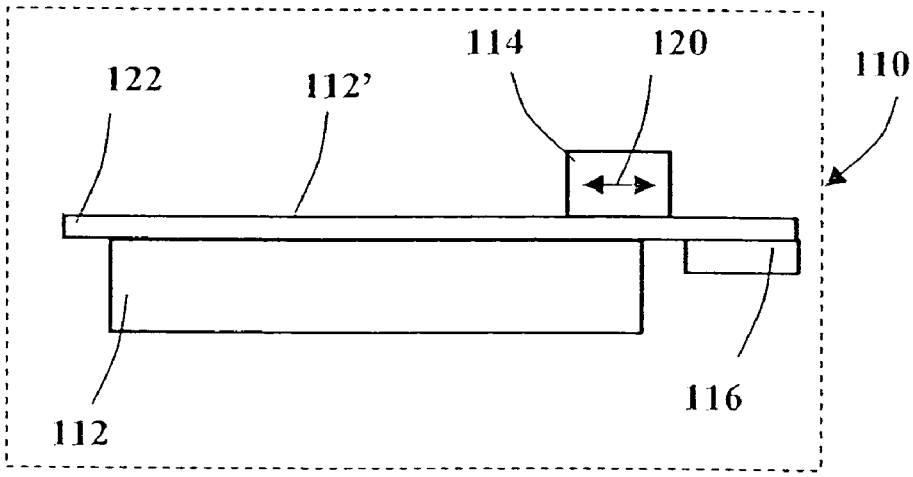
FIG. 5A is an elevation view of a simplified illustration of a flat bed type ink jet printer having a cleaning station constructed in accordance with the present invention.
Figure 5B:
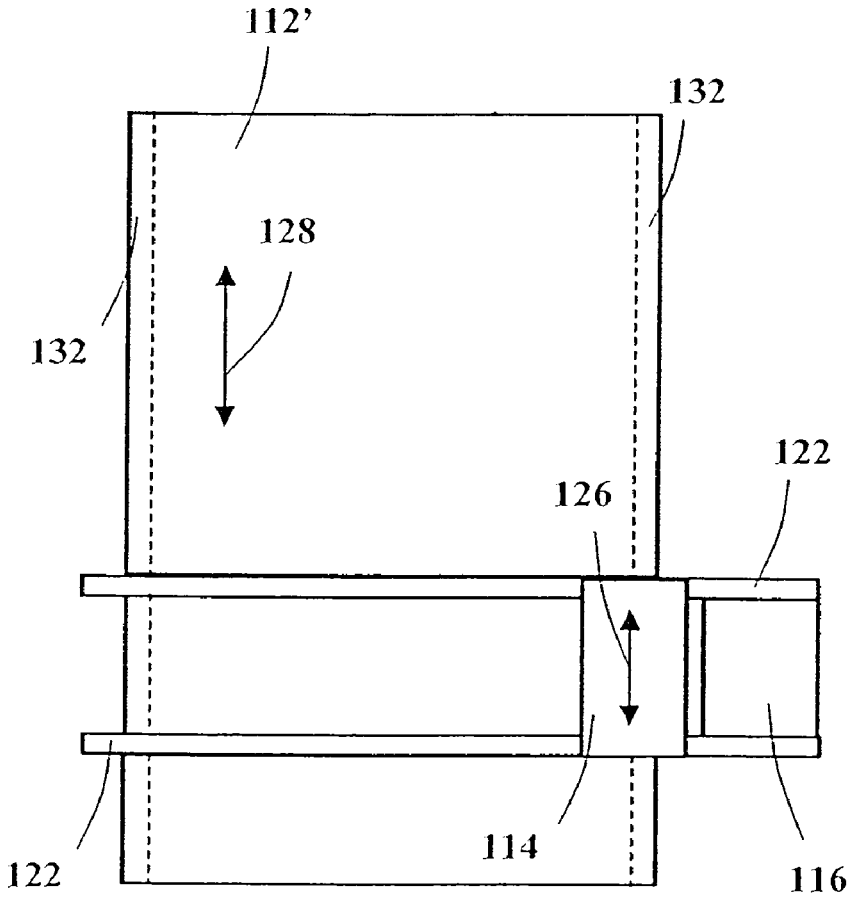
FIG. 5B is a plan view of a simplified illustration of a flat bed type ink jet printer having a cleaning station constructed in accordance with the present invention.

FIGS. 5A and 5B are respectively elevational and plan views of a simplified illustration of a flat bed type ink jet printer 110 having a cleaning and maintenance station constructed in accordance with the present invention. Ink jet printer 110 consists of a base 112 having a surface 112' for positioning on it rigid or flexible printed material, print head block 114, and cleaning and maintenance station 116. Print head block 114 reciprocates in the direction indicated by arrow 120 on linear guides 122. Cleaning and maintenance station 116 is rigidly coupled to linear guides 122 and may travel with linear guides 122 forth and back in the direction indicated by arrow 126. Arrow 126 indicates an ink jet printer architecture where linear guides 122 with print head block 114 and cleaning and maintenance station 116 are capable of moving in direction 126 in addition to the movement in direction indicated by arrow 120. Linear guides 132 facilitate the movement in the direction indicated by arrow 126. Alternatively, base 112 may be implemented of two parts, with upper part serving as a table and moving in the direction indicated by arrow 128.

Ink jet printer having a maintenance station 116 traveling with print head block 114 has the advantage of having higher printing duty cycle, since there is no need to move print head block 114 to a specific location for print head cleaning. Cleaning might become a part of each scanning pass or a number of scanning passes as required by the print head nozzle plate conditions and printing results.

For cleaning print head block 114 as part of scanning pass moves and positions over maintenance station 116. Airflow is activated and print head block 114 continues its movement in the direction indicated by arrow 120. Airflow 52 (FIGS. 1 and 2) cleans the orifice plates, removes ink residuals and debris, which are collected into debris collecting chamber 32. Alternatively print head block 114 may remain static during the cleaning process and airflow cleaning, arrangement move in the direction indicated by arrow 120. This however, may require use of additional airflow cleaning arrangement-moving system.

Figure 6A:
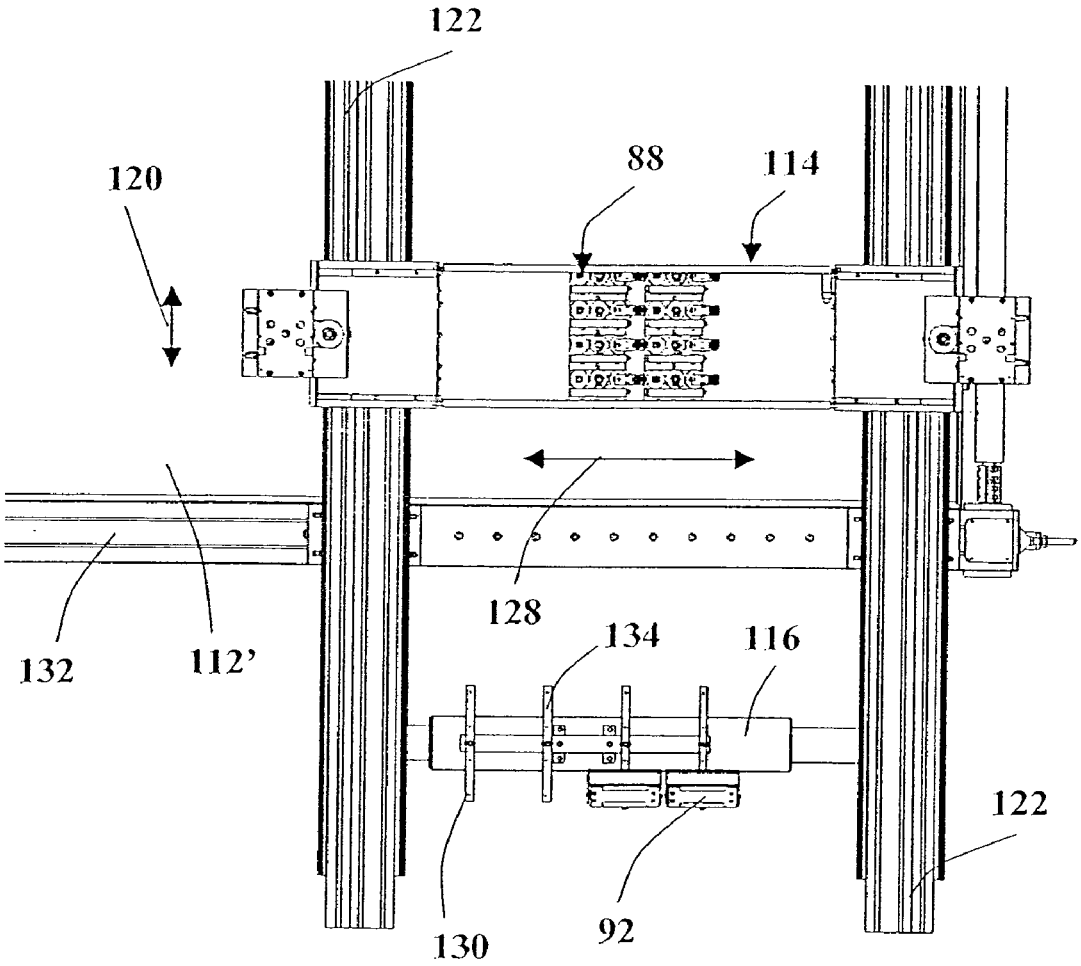
FIG. 6A is a more detailed elevation view of a simplified illustration of a flat bed type ink jet printer having a cleaning station constructed in accordance with the present invention.
Figure 6B:
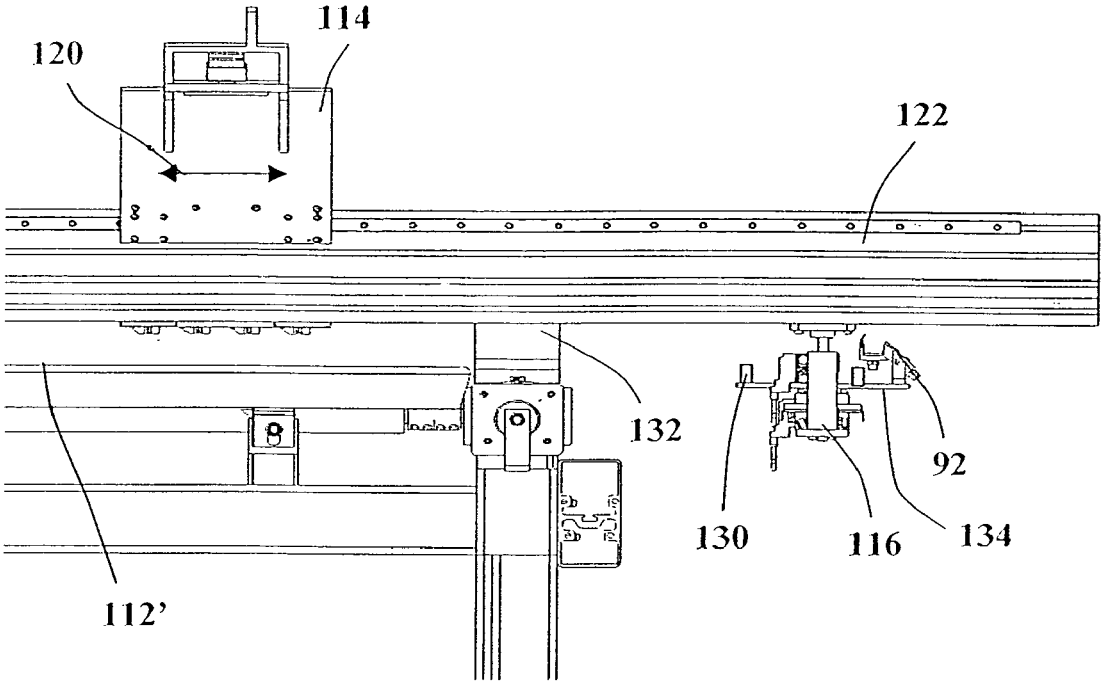
FIG. 6B is a more detailed plan view of a simplified illustration of a flat bed type ink jet printer having a cleaning station constructed in accordance with the present invention.

FIGS. 6A and 6B are respectively more detailed elevation and plan views of a simplified illustration of a flat bed type ink jet printer having a cleaning and maintenance station constructed in accordance with the present invention.

FIG. 6A shows print head block 114 reciprocating for printing purposes in the direction indicated by arrow 120 on guides 122 over surface 112'. Print head block 114 has eight print heads 88. For cleaning purposes print head block 114 continues to move in a regular type of movement passes over linear guide 132 until it reaches cleaning and maintenance station 116. At that time airflow flowing through air flow-cleaning arrangements 92 is activated and it cleans simultaneously all of the nozzles of nozzle plate (not shown) of print heads 88. This cleaning cycle may be performed at any time of the printing process when the whole assembly of linear guides 122, cleaning and maintenance station 116 and print head block 114 moves as part of a regular scanning pass in direction indicated by arrow 128.

In addition to air flow-cleaning arrangements 92 cleaning and maintenance station 116 has vacuum suction nozzles 130 mounted on mounts 134 and connected to a source of vacuum. When air flow-cleaning arrangements 92 is operative to clean a nozzle plate surface having a relatively large amount of ink residuals and debris to be removed, for example after print head purging, excessive ink may reach and reside on the edges of soft fluoro-silicone sidewall 34 (FIG. 2). Fluoro-silicone sidewall 34 may however, in case of need be used as a soft blade for wiping nozzle plate surface. UV radiation may cure these residue causing frequent replacement of fluoro-silicone sidewall 34, or making it not suitable for wiping operations. Vacuum suction nozzles 130 may be operated before air flow-cleaning arrangements 92 is operative. Vacuum suction nozzles 130 wick/vacuum excessive ink drops from print head nozzle plate surface leaving on it a minimal amount of ink and debris, which are easy, cleaned by air flow. Vacuuming of excessive amount of ink residuals from the whole surface of a nozzle plate may be accomplished by moving cleaning and maintenance station 116 along nozzle plate surface in the direction indicated by arrow 128.

Figure 7:
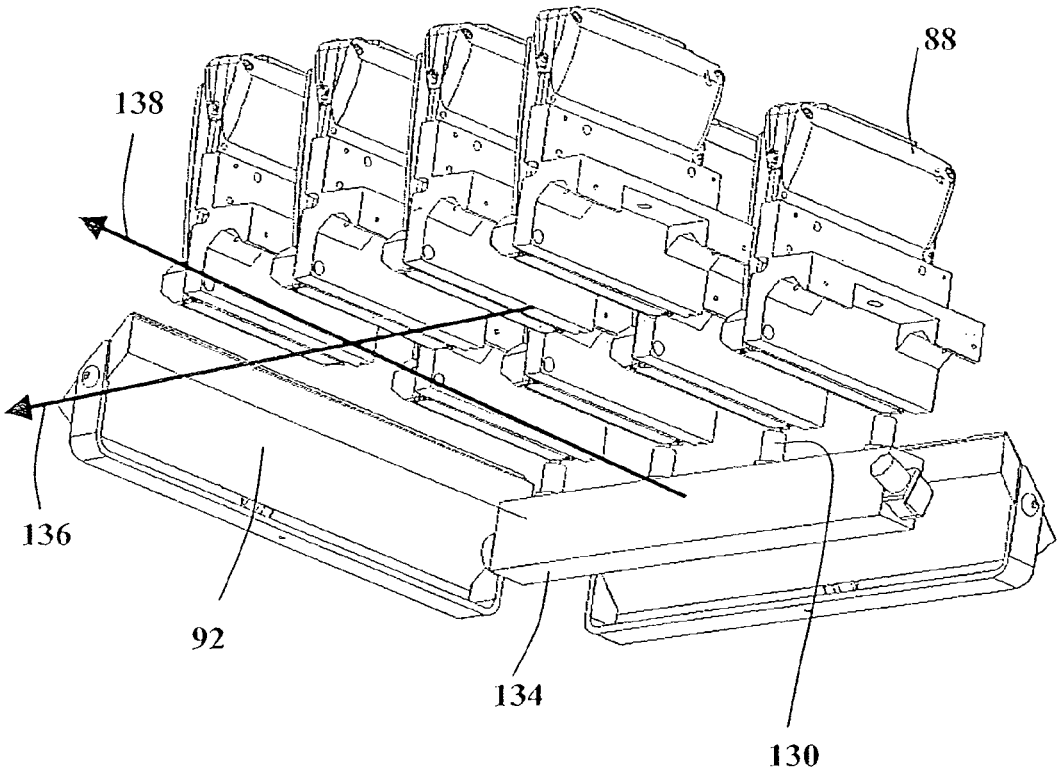
FIG. 7 is a detailed illustration of the cleaning a part of maintenance station with air flow-cleaning arrangements with vacuum suction nozzles of another exemplary embodiment of the non-contact nozzle plate surface cleaning device constructed in accordance with the present invention.

FIG. 7 is a detailed illustration of cleaning a part of maintenance station 116 constructed in accordance with the present invention showing air flow-cleaning arrangements 92 with vacuum suction nozzles 130 mounted on mounts 134. Vacuum suction nozzles 130 may move in direction indicated by arrow 138 in course of print head 88 purging process and wick/vacuum excessive amounts of ink generated by the purging process. Air flow-cleaning arrangements 92 may be operative at the end of each scanning cycle. This combination of vacuum suction of excessive ink amounts from print head nozzle plate surface with air flow-cleaning arrangements provides a true and complete non-contact print head nozzle plate surface cleaning solution.

The nozzles of ink jet print heads when idle should be closed to prevent nozzle clogging and ink drying on the nozzle plate surface. This operation is called capping. Capping stations are also implemented as a static portion of the substrate support surface or an additional portion of the machine. Capping commences at the end of each printing cycle when the print head becomes idle. This requires however to move and position the print head block over the capping station.

Figure 8:
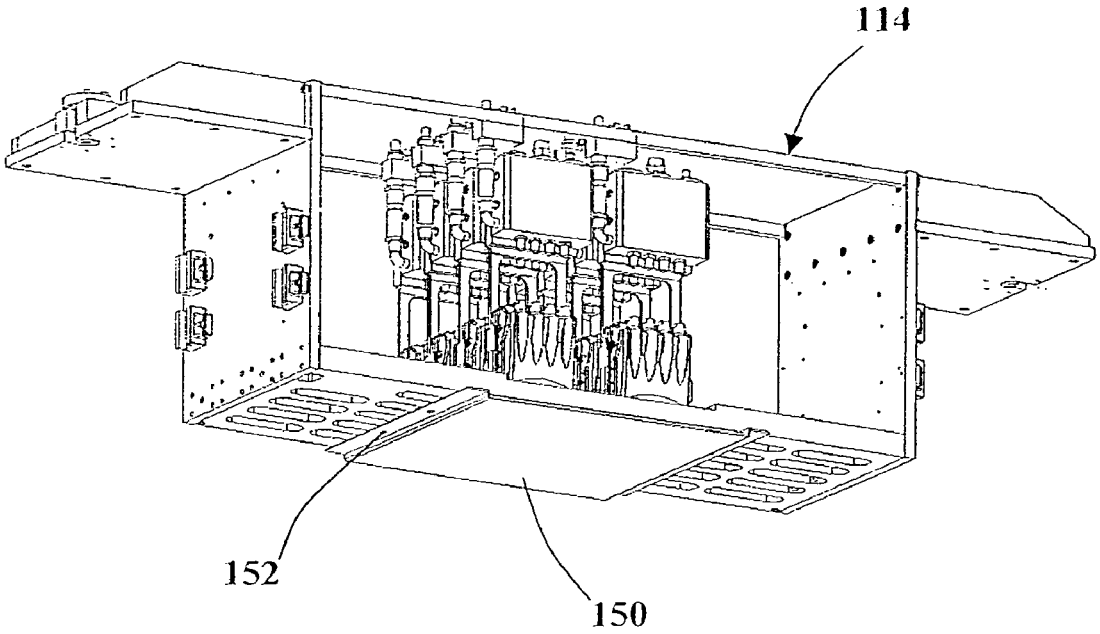
FIG. 8 is a schematic illustration of the ink jet print head capping station operating in accordance with the present invention and implemented as an arrangement traveling with the print head block.

In accordance with the present invention capping station may be implemented as an arrangement traveling with print head block 114. FIG. 8 is a schematic illustration of the ink jet print head capping station 150 operating in accordance with the present invention and implemented as an arrangement traveling with the print head block. In this exemplary embodiment capping station 150 is implemented as a stud mountable arrangement. Studs 152 prevent the movement of print head block 114 relative to capping station 150 and keep it firmly attached to the nozzle plate surface. Capping station may be implemented as a clip-on arrangement also.

Both the capping and the cleaning and maintenance station may be implemented as two separate modules. When one of the modules is operative it blocks access to the other module. One of the modules may be an airflow-cleaning module where the other module may provide the orifice plate capping function.

I claim:

1. A non-contact ink jet print head nozzle plate surface cleaning method, comprising steps of:

a) providing an ink jet print head with a nozzle plate having an open surface with major and minor dimension, and at least one linear array of ink ejecting nozzles substantially spanning said major dimension;

b) providing an arrangement having sidewalls and a bottom and where at least one of said sidewalls is parallel to said array of ink ejecting nozzles, said sidewall having a pressurized air conducting channel and an air exit slit exceeding said nozzle plate major dimension;

c) supplying a pressurized air stream exceeding through said slit in said sidewall and hitting at an angle said nozzle plate surface;

d) providing ink and debris collecting means being in communication with said arrangement bottom, and e) cleaning said jet print head nozzle plate surface by scanning said open surface with said pressurized air stream and collecting the ink residue and debris by said ink and debris collecting means.

2. A method as claimed in claim 1 and wherein said scanning is part of a regular scanning pass.

3. A method as claimed in claim 1 and wherein said scanning is part of a scheduled scanning pass.

4. A method as claimed in claim 1 and wherein a length of said air exit slit is equal or larger than said nozzle plate surface major dimension parallel to said air exit slit.

5. A method as claimed in claim 1 and wherein said ink jet print head has a two-dimensional nozzle array.

6. A method as claimed in claim 1 and wherein each section of said pressurized air stream cleans appropriate nozzle only of a nozzle array.

7. A method as claimed in claim 1 and wherein said angle at which pressurized air stream is hitting said nozzle plate surface is less than 90 degrees.

8. A method as claimed in claim 1 and wherein said ink and debris collecting means are disposable means such as sponge, cloth and similar.

9. A method as claimed in claim 1 and wherein said ink and debris collecting means is a drain.

10. A non-contact ink jet print head nozzle plate surface cleaning method, comprising steps of:

a) providing an ink jet print head with a nozzle plate having an open surface and at least one linear array of ink ejecting nozzles;

b) providing a vacuum suction arrangement, being capable of moving along said nozzle plate surface of said print head;

c) supplying a vacuum for removing excessive amounts of ink said nozzle plate surface;

d) providing an arrangement having sidewalls and a bottom and where at least one of said sidewalls is parallel to said array of ink ejecting nozzles, said sidewall having a pressurized air conducting channel and an air exit slit;

e) supplying a pressurized air stream exceeding through said slit in said sidewall and hitting at an angle said nozzle plate surface;

f) providing ink and debris collecting means being in communication with said arrangement bottom, and g) cleaning said jet print head nozzle plate surface by scanning said open surface with said vacuum suction and said pressurized air stream and collecting the ink residue and debris by said ink and debris collecting means.

* * * * *